US012728454B2

(12) United States Patent
Siegrist

(10) Patent No.: US 12,728,454 B2
(45) Date of Patent: Sep. 8, 2026

(54) FOLDING SHAFT DEVICE FOR A CLOSER, AND METHOD FOR FASTENING A CAN LID TO A CAN BODY

(71) Applicant: FERRUM PACKAGING AG, Schafisheim (CH)

(72) Inventor: Marco Siegrist, Rottenschwil (CH)

(73) Assignee: FERRUM PACKAGING AG, Schafisheim (CH)

( * ) Notice: Subject to any disclaimer, the term of this patent is extended or adjusted under 35 U.S.C. 154(b) by 312 days.

(21) Appl. No.: 18/275,196

(22) PCT Filed: Feb. 11, 2021

(86) PCT No.: PCT/EP2021/053274
§ 371 (c)(1),
(2) Date: Jul. 31, 2023

(87) PCT Pub. No.: WO2022/171279
PCT Pub. Date: Aug. 18, 2022

(65) Prior Publication Data

US 2024/0082903 A1 Mar. 14, 2024

(51) Int. Cl.
*B21D 51/26* (2006.01)
*B21D 51/32* (2006.01)

(52) U.S. Cl.
CPC ..... *B21D 51/2653* (2013.01); *B21D 51/32* (2013.01)

(58) Field of Classification Search
CPC .... B21D 51/2653; B21D 51/26; B21D 51/30; B21D 51/32; B21D 51/2661
See application file for complete search history.

(56) References Cited

U.S. PATENT DOCUMENTS

| | | | | |
|---|---|---|---|---|
| 10,759,551 | B2 | 9/2020 | Hirt et al. | |
| 2018/0078991 | A1* | 3/2018 | Obata | B21D 51/2684 |

FOREIGN PATENT DOCUMENTS

| | | | |
|---|---|---|---|
| DE | 102017009856.5 | A1 | 3/2019 |
| EP | 1213066 | A1 | 6/2002 |
| ES | 2217973 | A1 | 11/2004 |
| JP | 2000258267 | A1 | 9/2000 |
| WO | 9422614 | A1 | 10/1994 |

OTHER PUBLICATIONS

International Search Report issued Nov. 5, 2021 in corresponding International Application No. PCT/ EP2021/053274.

* cited by examiner

*Primary Examiner* — Teresa M Ekiert
(74) *Attorney, Agent, or Firm* — Spencer Fane, LLP

(57) ABSTRACT

A seaming shaft mechanism for a sealer for the attaching of a can lid to a can body includes a seaming shaft rotatable around a seaming axis, a seamer arranged at one end of the seaming shaft; as well as a sensor for the monitoring of the seaming process during the attachment of the can lid to the can body. The sensor is arranged at the seaming shaft such that the seaming process can be monitored by the sensor via a measurement of a displacement of the seaming shaft relative to the seaming axis or via a measurement of a torsion of the of the seaming shaft.

15 Claims, 6 Drawing Sheets

FOLDING SHAFT DEVICE FOR A CLOSER, AND METHOD FOR FASTENING A CAN LID TO A CAN BODY

CROSS-REFERENCE TO RELATED APPLICATION

This application is a U.S. National Stage application of PCT/EP2021/053274, filed Feb. 11, 2021, the contents of which are hereby incorporated by reference.

BACKGROUND

Technical Field

The disclosure concerns a seaming shaft mechanism for a sealer and a sensor for the seaming shaft mechanism according to the disclosure. The disclosure further concerns a sealer and a seaming station with a seaming shaft mechanism according to the disclosure, as well as a method for attaching of a can lid to a can body.

Background Information

During the conventional bottling of drink cans or food cans, cans run through a can sealer after the filling with a drink or a food, wherein the filled can bodies enter through an intake path and can lids (also lids) enter through an additional intake path. The can sealer usually contains several equal stations arranged in carousel-shape (also referred to as carousel in the following), within each of which respectively one can body is sealed with one can lid. The can lids are therein guided onto the can bodies and held on the can body with an ejection head arranged at the seaming head. This holding by the ejection head only occurs during a rising of the can (combination of can body and can lid). Afterwards the can is clamped into the seaming head for sealing. Within the can sealer the can bodies are then seamed over a seaming roller at the edges and thereby sealed. Normally, the can body with the can lid is then additionally rotated around its own axis of symmetry by the seaming head. For the rotation the seaming rollers and seaming heads are arranged on a respective seaming shaft.

A conventional can sealer is described in DE749636 and DE4234115 A1. The can sealer comprises a clamping mechanism for receiving a can to be sealed. In operating state, the can to be sealed is introduced into the clamping mechanism and secured by it in axial direction and at an upper end in a radial direction (by the seaming head). A can lid is also introduced centered over the can opening of the can body to be sealed. The can body has a circumferential can flange in the area of the can opening and the can lid has a circumferential can lid flange. For sealing the can opening by the can lid, the can sealer additionally comprises two seaming rollers, each mounted rotatably about an axis, which seaming rollers press the can flange and the can lid flange together by a force acting substantially radially, the pressing being effected by a continuous rolling along a circumferential direction of the can opening.

In the state of the art, there are units of seaming head and generally two seaming rollers arranged at a circumference of the carousel. Usually the sealer comprises a plurality of those units. In the running of the carousel the can lid is placed on the can body, the filled can body is lifted with the can lid against the seaming head and sealed. Afterwards the sealed can is lowered again and removed from the seaming head.

SUMMARY

It has been determined that during the entire sealing process of the cans errors can occur due to settings, worn seaming means or defects at the can. A high seaming quality of the cans does however have a high priority. A "bad seam" can exhibit, among others, errors such as scratches at the can lid, a macro-leakage, a micro-leakage or cut can parts in the product. These errors can not only result in faulty products, but also lead to the failure of the machine.

To identify such errors, information is collected and analyzed in the state of the art by the monitoring of the seaming process, in order to avoid machine outage times or excess rejects.

From the WO 2006/125680 A1 a mechanism for the monitoring of a double seaming sealing process is known. The mechanism comprises a lifting device for lifting of the can body, a sealing tool for a first and a second operation. By sensors for the detection of a strain and/or a force which affects the lifting device for the can, the sealing process can be monitored by analyzing a change in the base-load and divergences in the measured force. For that purpose, the sensors are mounted at a part of a lifting curve of the lifting device.

However, it has been determined that only larger defects, such as those known as "Skidders", which in particular lead to macro-leakages, can be detected by the mechanisms known from the state of the art. Additionally the processes from the state of the art only analyze the seaming process during the last can rotations.

It is thus an objective of the disclosure to provide a seaming shaft mechanism for a sealer and a seaming station, in particular a method, which avoid the negative effects known from the state of the art. In particular, a seaming shaft mechanism shall be provided which enables a more precise monitoring of the seaming process. Especially seaming forces shall be possible to be monitored continually and in real time during the seaming process. In particular it shall be made possible to analyze the entire seaming process with all seaming operations.

The objective is solved by a seaming shaft mechanism according to the disclosure, a sealer, as well as a seaming station with the seaming shaft mechanism according to the disclosure and by the method according to the disclosure.

According to the disclosure a seaming shaft mechanism for a sealer for attaching of a can lid to a can body comprising a seaming shaft rotatable around a seaming axis, a seaming means (device) arranged at one end of the seaming shaft as well as a sensor for the monitoring of a seaming process during the attaching of the can lid to the can body (meaning during the sealing of the can lid with the can body) is suggested. The seaming shaft mechanism according to the disclosure is characterized in that the sensor is arranged at the seaming shaft in such a way that the seaming process can be monitored by the sensor via a measuring of a displacement of the seaming shaft relative to the seaming axis and/or via measuring of a torsion of the seaming shaft.

During the seaming process compression and bending of the seaming shaft occurs. The seaming means is pushed away from the seam by the effective forces, which results in a compression/bending of the seaming shaft. These forces can be detected as displacement of the seaming shaft relative to the seaming axis or as torsion of the seaming shaft, by the sensor arranged at the seaming shaft according to the disclosure. In this way errors in the sealing can be detected by divergences of compression and bending or the forces measured and, as follows, by divergences in the displacement and/or the torsion (defects generally tend to exhibit a larger displacement/torsion, since the seaming means is pushed further away from the seam).

The torsion is the twisting of the seaming shaft vertically to the seaming axis. For the measurement of the torsion the sensor is preferably arranged in circumferential direction of the seaming shaft or alternatively the seaming means. For the measurement of the displacement the sensor is preferably arranged along the seaming shaft.

Hence a better identification of errors is made possible compared to the WO 2006/125680 and other mechanisms of the state of the art, as measurements are taken directly at the seaming shaft and not indirectly at a curve, which is only involved in the seaming process over several parts and levers. The thus occurring delays, damping and translations between the machine parts can consequently be avoided by the mechanism according to the disclosure. Furthermore, not only one end of the last seaming operation is observed, but rather the entire seaming process can be analyzed.

Seaming forces can thus be detected in real time by the disclosure, which can in particular occur by a measuring of force and/or strain at the seaming shaft. Seaming defects (such as "skidders", something wedged in the seam, a missing lid, . . . ) lead to a "conspicuous" force trend and/or strain trend during the seaming and can thus be detected based on this. Additionally, not only seaming defects can be monitored, but in particular also wear of the seaming means can be monitored (e.g., via a force which lessens over time/compression and thus displacement).

In execution of the disclosure the sensor for the measuring of the displacement and/or torsion of the seaming shaft can be arranged at a jacket of the seaming shaft. Additionally, the sensor can be arranged at an inner lateral surface of the seaming shaft and/or at an outer lateral surface of the seaming shaft. If the sensor is arranged at the outer lateral surface, in particular on the outer lateral surface and thus on the surface of the seaming shaft mechanism, the displacement and/or the torsion can be determined via a surface strain of the seaming shaft. Additionally, the sensor can be arranged at the seaming shaft via the seaming means. Here the sensor can also be arranged within the seaming means, or be arranged on the seaming means (e.g., printed onto the seaming means).

The seaming means is preferably arranged detachably at one end of the seaming shaft, can thus be attached to the seaming shaft via an attachment mechanism and thus be exchanged (e.g., for a change in tools).

The seaming shaft can be designed as a seaming head shaft and the seaming means as a seaming head for the affixing of the can lid to the can body. The seaming axis is then the axis around which the seaming head shaft or the seaming head rotate in operating mode.

Alternatively, or additionally, the seaming shaft can be designed as a seaming roller shaft and the seaming means as a seaming roller for the seaming of the can lid to the can body. The seaming axis is then (alternatively or additionally) the axis around which the seaming roller shaft or the seaming roller rotate in operating state.

In practice the seaming shaft mechanism according to the disclosure can include an ejection mechanism with an ejection rod, a gliding profile and an ejection head, wherein the ejection rod is arranged movably within the seaming head shaft and the ejection head is arranged at a second end of the ejection rod in such a way that the ejection head is arranged in between the seaming head shaft and the gliding profile for movement along the gliding profile. Such ejection mechanisms with seaming curve are already known from the state of the art.

Especially preferred the sensor is a force sensor and/or an a strain sensor, so that the displacement and/or the torsion of the seaming shaft can be determined through a measuring of force and/or a measuring of strain at the seaming shaft (and thus as force trend and/or strain trend). Herein the sensor can be a strain measuring strip and/or a piezo force sensor. Such sensors can also be applied directly via the printing of nano-inks.

The strain measuring strip is hereby suited for the detection of expanding or compressing deformations of the seaming shaft. The strain measuring strip already changes its electrical resistance even at minor deformations and can thus detect the displacements or torsions of the seaming shaft. In principle the strain measuring strip can be arranged on the surface of the seaming shaft, (e.g., with specialist glue). The strain measuring strip can for example be a foil-, wire- and semiconductor-strain measuring strip as well as a multi-strain measuring strip.

The piezo force sensor comprises a piezoelectric crystal (such as, e.g., quartz). If a force affects the piezoelectric crystal this causes a change in charge. The charge is here proportional to the affecting force. Via a charge-amplifier the charge is converted into a volt-signal, via which the displacement and/or torsion of the seaming shaft can be detected, in particular as strain trend or force trend.

Obviously other force- and strain sensors or also other sensor types such as, e.g., distance sensors, can also be used to detect the displacement and/or torsion of the seaming shaft.

The sensor can also include a first sensor, a second sensor and a third sensor. Here the first sensor, the second sensor and the third sensor can be arranged at different positions along a circumference of the seaming shaft and also, in particular, arranged at a same height of the seaming axis. They can be arranged at an even distance from each other, in particular placed at a distance of 120° from each other. In principle an arbitrary number of sensors can be used, which are preferably spread evenly along the circumference of the seaming shaft.

In an especially preferred embodiment, the seaming head shaft comprises three strain measuring strips as sensors, which are placed at a distance of 120° from each other along the circumference of the seaming head shaft at equal height. There can however also be more sensors used, for example four or five sensors. In that way a failure of a sensor can be compensated, and measuring results of a sensor can be verified.

Through this a measuring of the strain, as a function of the force, can happen very close to the "scene of the event", a force trend can be measured across the entire seaming process and a recording of the force in three spatial directions is made possible.

According to the disclosure a seaming station with a seaming shaft mechanism according to the disclosure is proposed, wherein the seaming station comprises a lifting element and the can body with the can lid is arranged between the lifting element and the seaming head as first seaming means during the seaming process.

As a seaming means the seaming station preferably also comprises a first seaming roller and in particular a second seaming roller for attaching the can lid to the can body.

According to the disclosure a sealer, which comprises a carousel with a plurality of seaming shaft mechanisms according to the disclosure (or a plurality of seaming stations according to the disclosure) is further proposed. The sealer is thus preferably a can sealer. Here the sealer according to the disclosure can also include a first intake for can bodies, in particular for can bodies filled with a product, to the carousel, and a second intake for can lids to the carousel. Furthermore, the sealer can include an outlet for seamed cans from the carousel.

For sealing the can the can sealer (or the seaming shaft mechanism) preferably comprises one or several seaming rollers (as known from the state of the art). In operating state, the seaming rollers are brought into contact with the can lid flange of the can lid and the can flange of the can body with their respective seaming profile. By rotation of the can the seaming roller is then rotated in circumferential direction of the can, whereby the can flange is seamed with the can lid flange. For rotating the can, the can is preferably clamped in between the seaming head and a support (in particular the lifting element), whereby the seaming head is rotated around the seaming axis with the seaming shaft. In the case of two or more symmetrically effective seaming rollers the force ratios are different from a single seaming roller, since an opposite seaming roller always supports the seaming head.

Within the scope of the disclosure the can can be understood as a container, which is sealed by the can sealer and the corresponding seaming roller. A can can preferably comprise plastic, carton or a metal, in particular aluminum or steel.

In principle, the sealer according to the disclosure can be analogous to the can sealers already known from the state of the art, but it differs in the seaming head mechanism as well as the sensors (in particular the arrangement of the same). Here the advantage emerges that can sealers/sealers with the seaming head mechanism according to the disclosure can be modified to avoid the disadvantages of the state of the art.

In principle, the sealer (or the seaming head mechanism) can preferably include at least two seaming rollers with preferably two different seaming profiles, so that cans can be sealed according to a double-seaming principle, in which the cans are, as a rule, sealed in two steps. One seaming roller is each here responsible for one step.

According to the disclosure a method for attaching of a can lid to a can body is further proposed. Here a seaming shaft mechanism according to the disclosure is provided. Can lids and can bodies are supplied to the seaming head mechanism. The can lid is placed on the can body and the can body is positioned on the lifting element. Subsequently the can lid is seamed with the can body, in particular by at least one seaming roller, especially with two seaming rollers and their seaming head. In particular the displacement and/or torsion of the seaming head is then detected during the seaming process by the sensors, in order to monitor the attachment of the can lid to the can body and to identify errors. Thereby a sorting out of faulty cans can also be enabled for example.

If the method according to the disclosure is executed with a sealer according to the disclosure can lids and can bodies can be guided together at a defined point before the actual seaming process. The supplying of the can lids preferably occurs via a gassing rotor on which the can lids lie. The can bodies are supplied by a container supply. The can bodies get from the container supply onto one of the respective lifting elements (which are integrated into the carousel). At a turning of the carousel the lifting elements preferably execute a cam-controlled lifting motion to insert the can bodies to the can lids from below and later into the seaming head.

BRIEF DESCRIPTION OF THE DRAWINGS

Embodiments of the invention will be explained in more detail with reference to the drawings.

DETAILED DESCRIPTION

Figure 1:
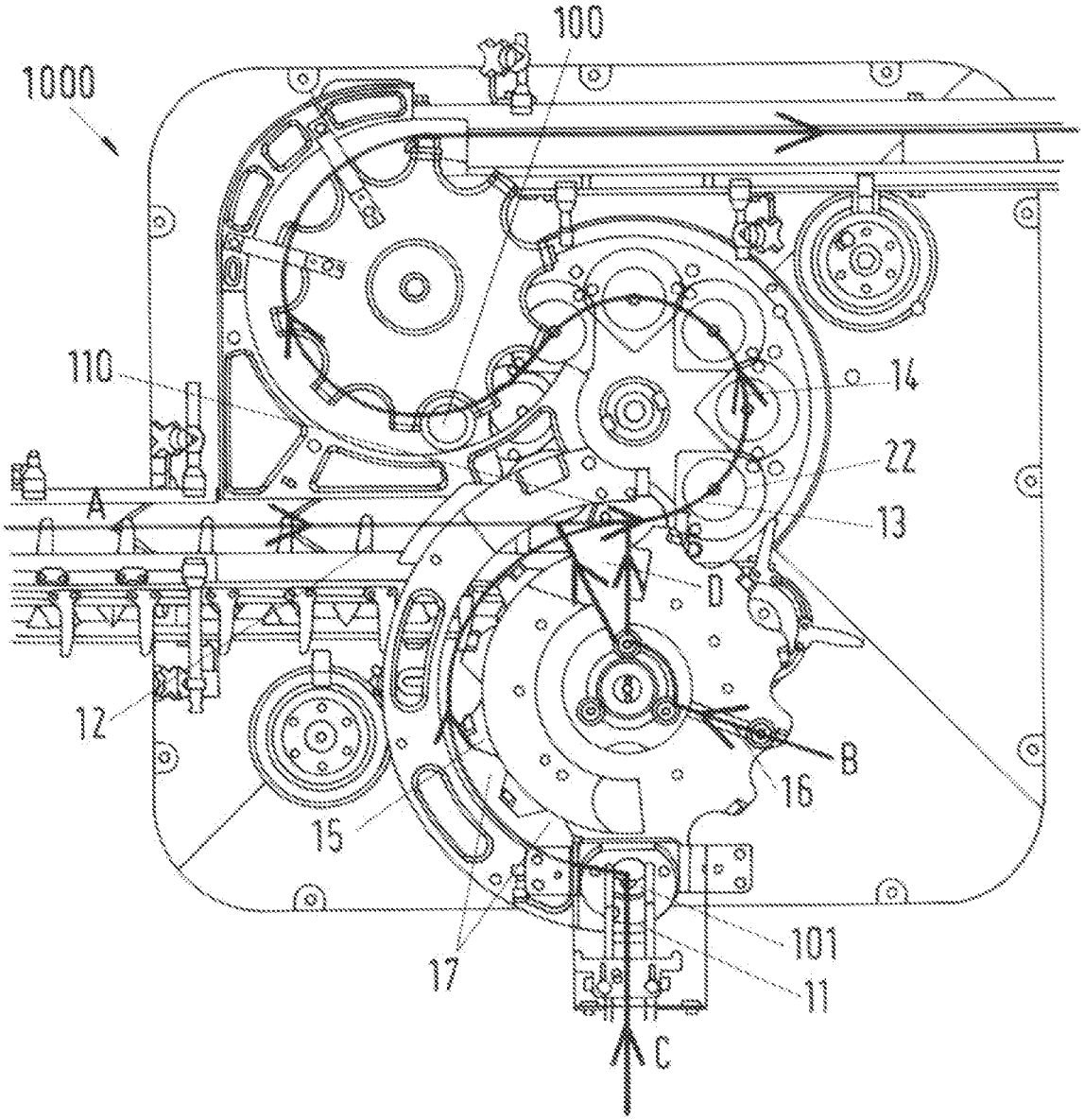
FIG. 1 illustrates a plan-view of a sealer according to the disclosure.

FIG. 1 shows a plan view of a sealer 1000 according to the disclosure.

The sealer (closer) 1000 for the sealing of a can comprises a lid supplier 11 for the supplying of a can lid 101 to a can body 100, a gassing rotor 15 for the supplying of gas to the can body 100 and a seaming station 14 for the sealing of the can body 100 with the can lid 101.

In operating state, the can lid 101 is brought into the sealer 1000 along the arrow C by the lid supply 11. Here the can lids 101 are arranged on the gassing rotor 15. By rotation of the gassing rotor 15 the can lids 101 are transported further. Then the can bodies 100 are brought into the container receivers 17 of the gassing rotor 15 by the container supply 12. There the can body 100 is gassed with a gas such as carbon dioxide or nitrogen in area D and united with the can lid 101 at 110.

The gassing happens along the arrow B with the gas supply 16. After the gassing the can body 100 with the can lid 101 is guided onward through the container outlet 13 by the gassing rotor 15 to the seaming station 14 and sealed there.

Before the actual seaming process can lids 101 and can bodies 100 are united as previously described. The can bodies 100 are supplied linearly via the container supply 12. The can bodies get from the container supply 12 to one of the respective lifting elements 22 of the seaming station 14, which is designed as a carousel (preferably arranged in form of a master shaft). At one turn of the carousel the lifting elements 22 execute a cam-controlled lifting motion, wherein the can bodies 100 are guided to the can lids 101 from below. After a pre-determined lifting distance, the can body 100 and the can lid 101 touch and can subsequently be sealed.

A seaming process can be monitored during the sealing of the can body with the can lid and errors can be identified by a seaming shaft mechanism (forming shaft mechanism) according to the disclosure within seaming station 14.

Figure 2:
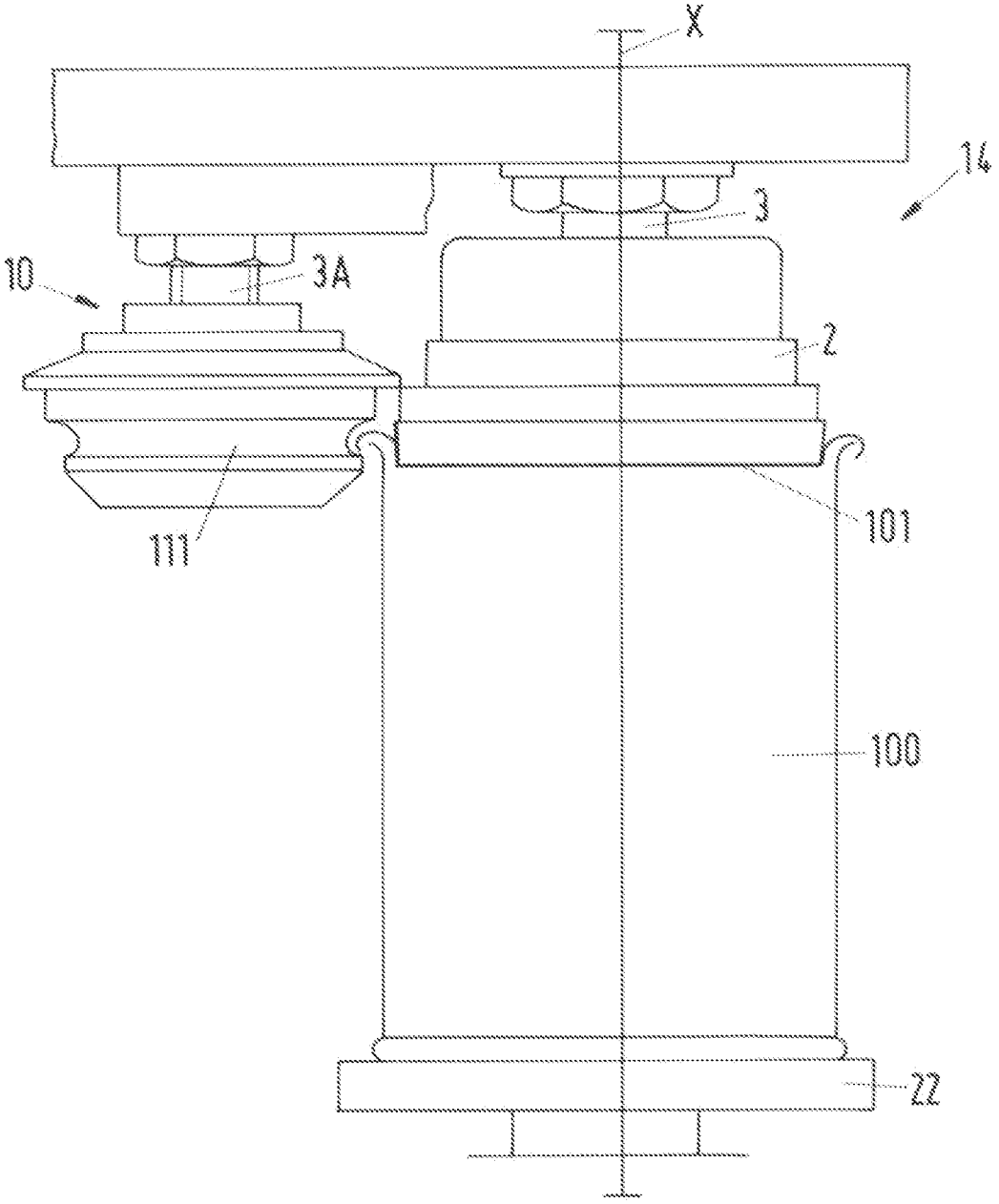
FIG. 2 illustrates a side view of a seaming station.

FIG. 2 shows a side view of a seaming station 14 according to the disclosure with a can body 100 to be sealed and a can lid 101.

According to FIG. 2 the seaming station 14 comprises a clamping mechanism, which comprises the lifting element 22 and a seaming head 2, wherein the seaming head 2 is attached via the seaming head shaft 3. Additionally the seaming station 14 comprises at least one seaming roller 10 with a seaming profile 111, which is mounted rotatable over a seaming roller shaft 3A. The can lid 101 is arranged centrally over the opening of the can body 100. The can body 100 has a circumferential can flange in the area of the can opening and the can lid 101 has a circumferential can lid flange.

During the sealing process the seaming roller 10 is brought into contact with the can flange and the can lid flange over the seaming roller profile 111. Here the can flange and the can lid flange are crimped together by an essentially radially effective force via the seaming roller 10. The crimping happens there through a continuous rolling of the seaming roller 10 in circumferential direction along the circumference of the can opening.

For sealing the can body 100 is rotated by the clamping mechanism, by the seaming head 2 being rotated around the seaming axis X (corresponds to an axial direction) with the seaming head shaft 3.

A sensor according to the disclosure for the monitoring of the seaming process via a measuring of a displacement and/or a torsion of the seaming shaft can be arranged at the seaming roller shaft 3A and/or the seaming head shaft 3. Especially preferred the sensor is at least arranged at the seaming head shaft 3.

Figure 3:
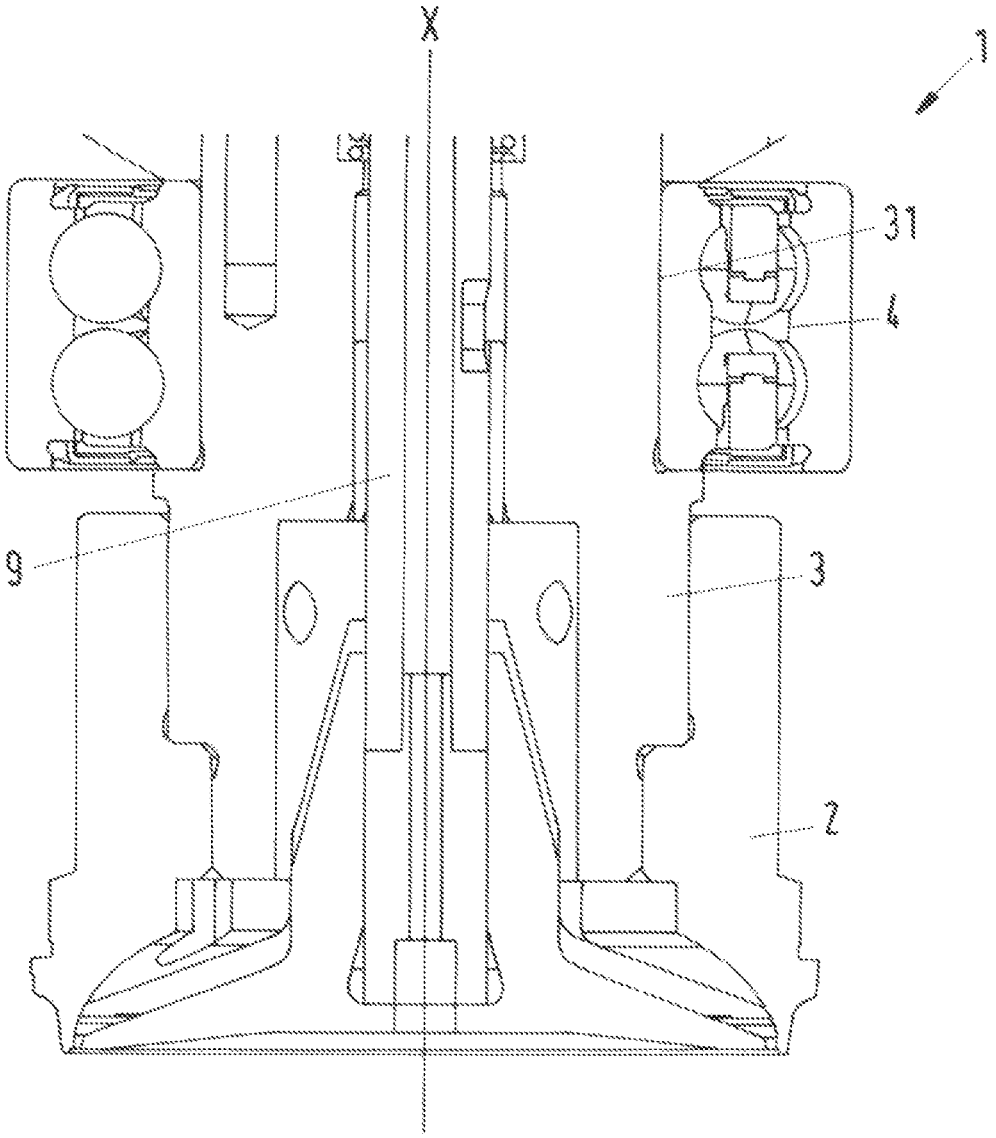
FIG. 3 illustrates a cross-section of a seaming shaft mechanism according to the disclosure.

FIG. 3 shows a cross-section of a seaming shaft mechanism 1 according to the disclosure.

The seaming shaft mechanism 1 comprises the seaming head shaft 3, which is rotatable around the seaming axis X, a seaming head 2 arranged at one end of the seaming head shaft 3 and sensors 4 for the monitoring of the seaming process.

The sensors 4 are arranged at the jacket 31 of the seaming head shaft 3 in such a way, that the seaming process can be monitored via a measuring of the displacement of the seaming head shaft 3 relative to the seaming axis X by the sensors 4.

In that, the displacement of the seaming head shaft 3 is detected, preferably continuously, in operating state by the sensors 4. The sensors 4 are here preferably force sensors and/or strain sensors, which determine the displacement of the seaming head shaft via a measuring of force and/or a measuring of strain. Preferably there are at least three sensors arranged along a circumference of a seaming head shaft at a same height of the seaming axis X.

Figure 4A:
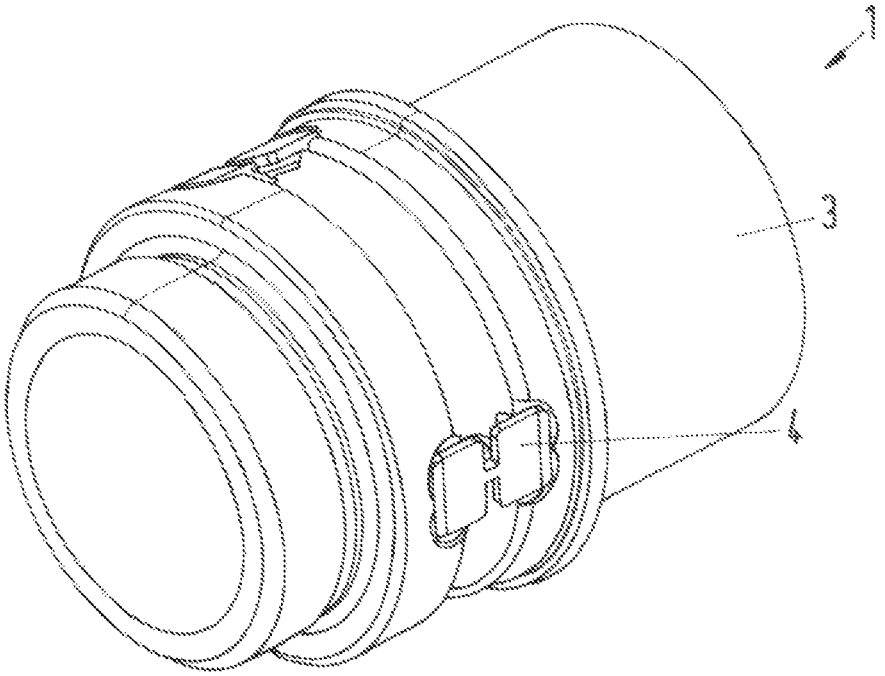
FIG. 4A illustrates a section of a seaming shaft mechanism according to the disclosure without a seaming means.

FIG. 4A shows a section of a seaming shaft mechanism 1 according to the disclosure. Three strain sensors 4 in the form of strain measuring strips 4 are evenly spread along the circumference of the seaming head shaft 3 and arranged above an attachment spot for the non-depicted seaming head. The displacement can be detected as strain of the seaming head shaft 3.

Figure 4B:
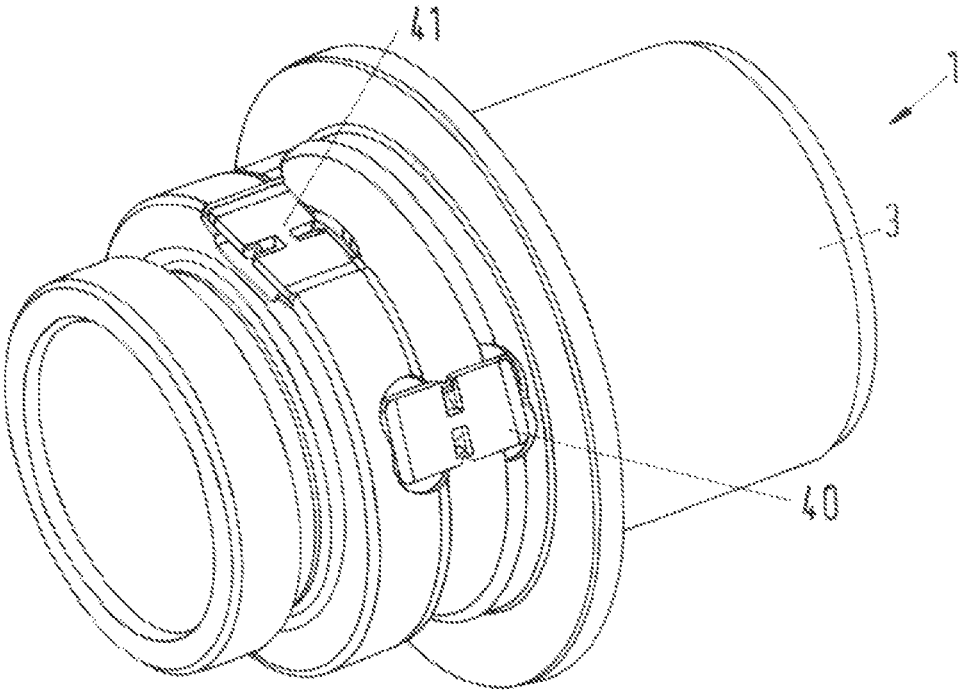
FIG. 4B illustrates a section of a further seaming shaft mechanism according to the disclosure without a seaming means.

FIG. 4B shows a section of a seaming shaft mechanism 1 according to the disclosure. Here there are at least two strain sensors in the form of strain measuring strips 40, 41 along the circumference of the seaming head shaft 3 and arranged at/above the attachment spot for the non-depicted seaming head. In practice the sensors can however be arranged at an arbitrary spot at the seaming head shaft, such as for example also below and/or within the seaming head.

The sensor 40 is arranged in direction of the seaming axis, so that the displacement of the seaming head shaft 3 relative to the seaming axis can be detected. By contrast the sensor 41 is arranged in circumferential direction of the seaming head shaft 3, so that the torsion of the seaming head shaft 3 relative to the seaming axis can be detected.

So, the torsion and the displacement can be determined. The torsion can however be determined independently from the displacement by the sensors 41. Naturally a plurality of sensors 40 and/or 41 can also be used.

Figure 5:
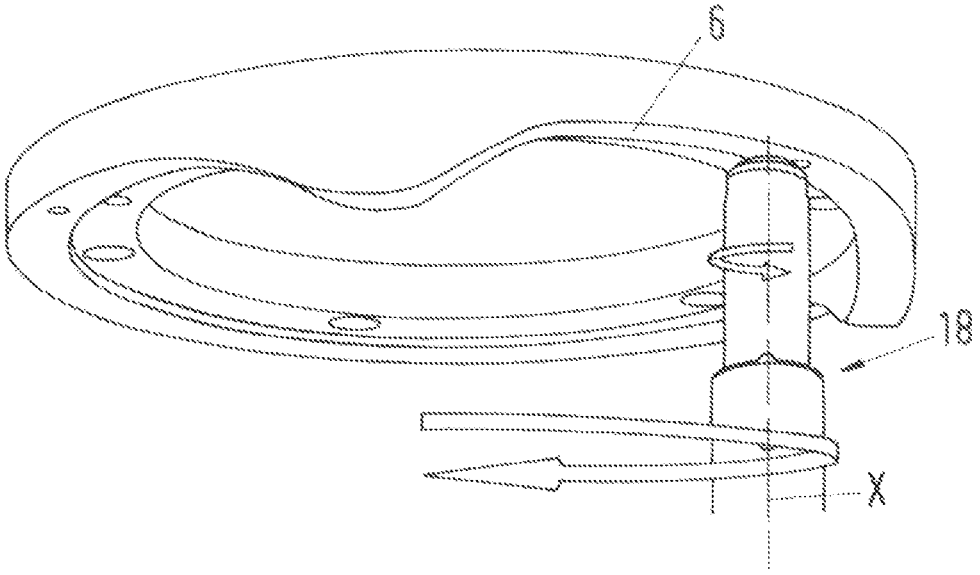
FIG. 5 illustrates an ejection head for a seaming shaft mechanism according to the disclosure.

FIG. 5 shows an ejection head 18 for a seaming shaft mechanism according to the disclosure in operation. Such an ejection head 18 is basically known from the state of the art.

The ejection head 18 glides along a gliding profile of a seaming curve 6. To achieve both the functions of pinning down the container and ejecting the container the gliding profile 6 has two sections with an elevated level. In this one section with an elevated level of the gliding profile 6 corresponds to the function of pinning down the container, during which the container to be sealed is pinned for the sealing process and by the ejection mechanism and centered for the lid sealing and the other section with elevated level of the gliding profile 6 corresponds to the function of the container ejection, during which the sealed container is ejected from the sealing machine by the ejection mechanism. While the container is pinned and while the container is ejected the ejection head 18 is moved along the gliding profile 6 and can also rotate around the axis X.

Figure 6:
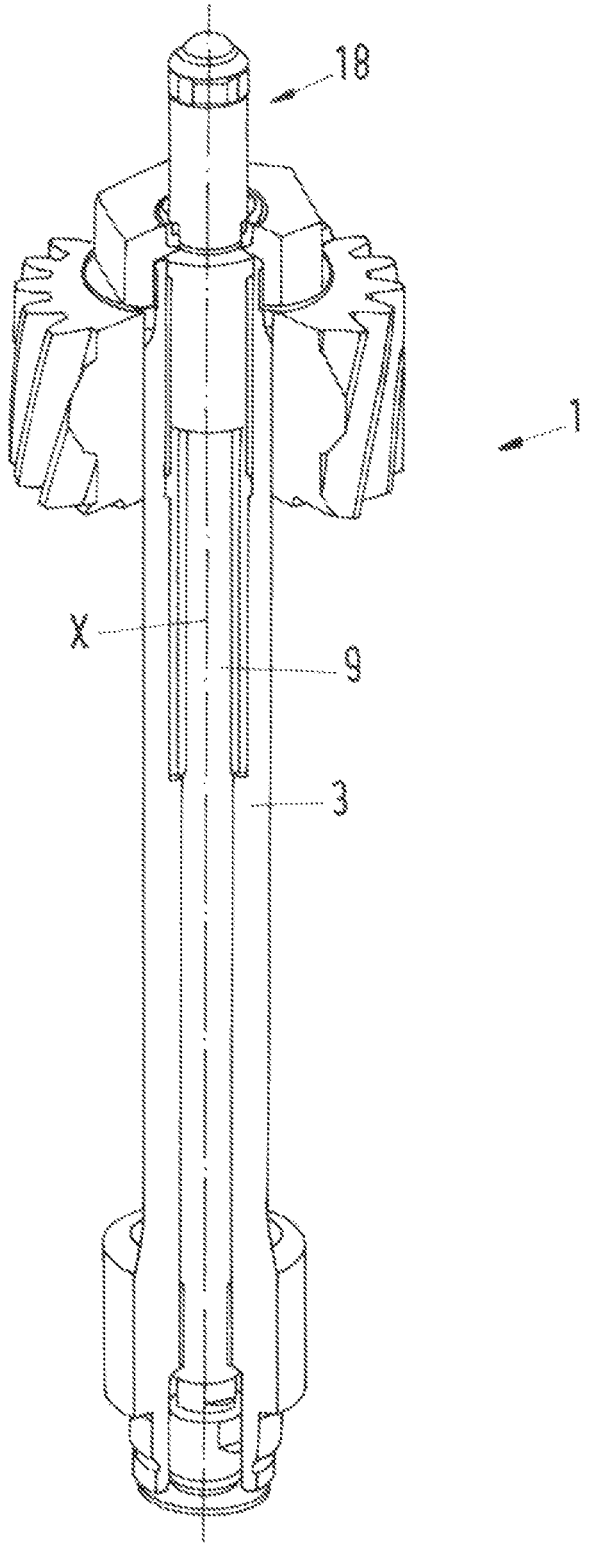
FIG. 6 illustrates a seaming shaft mechanism with ejection head according to the disclosure.

FIG. 6 shows the seaming shaft mechanism 1 with the ejection head 18 and an ejection rod 9, with which the ejection head 18 is detachably connected.

The ejection rod 9 is movably arranged within the seaming head shaft 3 and the ejection head 18 is arranged at a second end of the ejection rod 9 in such a way that the ejection head 18 is arranged in between the seaming head shaft 3 and the gliding profile for movement along the gliding profile (not depicted here).

During operation a force can be transferred onto the ejection rod 9, and thus onto the can, via the ejection head 18.

The invention claimed is:

1. A seaming shaft mechanism for a sealer for attaching of a can lid to a can body, comprising:

a seaming shaft rotatable around a seaming axis;

a seamer arranged at one end of the seaming shaft;

a seaming head shaft with a seaming head configured to affix the can lid to the can body; and a sensor configured to monitor a seaming process during the attachment of the can lid to the can body, the sensor is arranged at the seaming shaft or the seamer and configured to monitor the seaming process via measurement of a displacement of the seaming shaft relative to the seaming axis and/or via measurement of a torsion of the seaming shaft, the seaming shaft being a seaming roller shaft and the seamer being a seaming roller configured to seam the can lid to the can body.

2. The seaming shaft mechanism according to claim 1, wherein the sensor is arranged at a jacket of the seaming roller shaft.

3. The seaming shaft mechanism according to claim 1, wherein the seamer is detachably arranged at an end of the seaming roller shaft.

4. The seaming shaft mechanism according to claim 1, wherein the sensor is arranged at an inner lateral surface of the seaming roller shaft.

5. The seaming shaft mechanism according to claim 1, wherein the sensor is arranged at an outer lateral surface of the seaming roller shaft.

6. The seaming shaft mechanism according to claim 1, further comprising an ejection mechanism with an ejection rod, a gliding profile and an ejection head, wherein the ejection rod is arranged movably within the seaming head and the ejection head is arranged at a second end of the ejection rod in such a way, that the ejection head is arranged between the gliding profile and the seaming head shaft to be moveable along the gliding profile.

7. The seaming shaft mechanism according to claim 1, wherein the sensor is a force sensor or a strain sensor, so that the displacement and/or the torsion of the seaming shaft is determinable via a force measurement or a strain measurement at the seaming roller shaft.

8. The seaming shaft mechanism according to claim 7, wherein the sensor is a strain measurement strip or a piezo force sensor.

9. The seaming shaft mechanism according to claim 1, wherein the sensor comprises a first sensor, a second sensor and a third sensor.

10. The seaming shaft mechanism according to claim 9, wherein the first sensor, the second sensor and the third sensor are arranged at different positions along a circumference of the seaming shaft.

11. The seaming shaft mechanism according to claim 10, wherein the first sensor, the second sensor and the third sensor are arranged at a same height of the seaming axis.

12. A seaming station comprising:

the seaming shaft mechanism according to claim 1 and a lifting element for lifting the can body with the can lid.

13. A sealer, comprising:

a carousel with a plurality of seaming shaft mechanisms, each seaming shaft mechanism of the plurality of shaft mechanisms being configured according to claim 1;

a first intake configured to intake the can body to the carousel;

a second intake configured to intake the can lids to the carousel; and an outlet configured to outlet the seamed can from the carousel.

14. A method for the attaching of the can lid to a can body, comprising:

providing the seaming shaft mechanism according to claim 1;

supplying the can lid and the can body to the seaming shaft mechanism;

positioning the can lid on the can body;

positioning the can body on a lifting element;

seaming the can lid to the can body.

15. A sensor for the seaming shaft mechanism according to claim 1.

* * * * *